US007802790B2

(12) United States Patent
Shimizu

(10) Patent No.: US 7,802,790 B2
(45) Date of Patent: Sep. 28, 2010

(54) IMAGE GENERATING APPARATUS WITH PAPER CASSETTE HAVING PRESSING PORTION

(75) Inventor: Daisuke Shimizu, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 0 days.

(21) Appl. No.: 12/110,066

(22) Filed: Apr. 25, 2008

(65) Prior Publication Data

US 2008/0272534 A1 Nov. 6, 2008

(30) Foreign Application Priority Data

May 1, 2007 (JP) ..... 2007-120603

(51) Int. Cl.
*B65H 9/10* (2006.01)

(52) U.S. Cl. ..... 271/241; 271/240; 271/145

(58) Field of Classification Search ..... 271/241, 271/240, 145

See application file for complete search history.

(56) References Cited

U.S. PATENT DOCUMENTS

| | | | | |
|---|---|---|---|---|
| 5,651,540 | A | 7/1997 | Watanabe et al. | |
| 2003/0178764 | A1* | 9/2003 | Hasegawa | 271/171 |
| 2005/0179194 | A1* | 8/2005 | Saito | 271/162 |
| 2005/0242492 | A1* | 11/2005 | Yang | 271/171 |
| 2006/0049573 | A1* | 3/2006 | Takasaka et al. | 271/121 |
| 2007/0040321 | A1* | 2/2007 | Shimizu et al. | 271/109 |

FOREIGN PATENT DOCUMENTS

| | | | |
|---|---|---|---|
| JP | 59007634 | A * | 1/1984 |
| JP | 05-077945 | | 3/1993 |
| JP | 7-61628 | A | 3/1995 |
| JP | 7-101562 | A | 4/1995 |
| JP | 7-309456 | A | 11/1995 |
| JP | 07309456 | A * | 11/1995 |
| JP | 09-025025 | | 1/1997 |
| JP | 3723664 | B2 | 2/1999 |
| JP | 2900655 | B2 | 3/1999 |
| JP | 2966243 | B2 | 8/1999 |
| JP | 2005-298112 | A | 10/2005 |

OTHER PUBLICATIONS

Office Action in corresponding Japanese Patent Appl. No. 2007-120603, dated Jun. 2, 2009.
Japanese Office Action dated Feb. 24, 2009 with English translation (four (4) pages).

* cited by examiner

*Primary Examiner*—Gene Crawford
*Assistant Examiner*—Gerald W McClain
(74) *Attorney, Agent, or Firm*—Crowell & Moring LLP

(57) ABSTRACT

In this image generating apparatus, a paper cassette mounted on an apparatus body includes a pressing portion employed for pressing a first side surface of a paper rearward with respect to a first direction for feeding the paper and so arranged that the distance from a second roller is smaller than the length of the paper in the first direction when the paper cassette is mounted on the apparatus body.

16 Claims, 9 Drawing Sheets

IMAGE GENERATING APPARATUS WITH PAPER CASSETTE HAVING PRESSING PORTION

BACKGROUND OF THE INVENTION

1. Field of the Invention

The present invention relates to an image generating apparatus, and more particularly, it relates to an image generating apparatus comprising an apparatus body mountable with a paper cassette and a roller feeding papers.

2. Description of the Background Art

An electronic apparatus such as an image generating apparatus comprising an apparatus body mountable with a paper cassette and a roller feeding papers is known in general (refer to Japanese Patent Nos. 2966243 and 2900655, Japanese Patent Laying-Open No. 2005-298112 and Japanese Patent No. 37233664, for example).

The aforementioned Japanese Patent No. 2966243 discloses a laser beam printer (image generating apparatus) comprising a paper feed cassette (paper cassette) capable of storing sheet materials (papers), a paper feed roller feeding the sheet materials to a printer body, protrusive reference guides provided on the paper feed cassette to be arranged on upstream and downstream sides with respect to the direction for feeding the sheet materials respectively and side regulation springs (pressing portions) pressing second side surfaces of the sheet materials to bring first side surfaces of the sheet materials into contact with the reference guides. In this laser beam printer according to Japanese Patent No. 2966243, the protrusive reference guide provided on the upstream side is so formed as to come into contact with portions of the sheet materials close to ends on the upstream side (rear side with respect to the paper feed direction) while the length thereof is rendered larger than that of the protrusive reference guide provided on the downstream side (front side with respect to the paper feed direction), thereby previously inclining the sheet materials stored in the paper cassette.

The aforementioned Japanese Patent No. 2900655 discloses a paper feeder (electronic apparatus) comprising a paper feed cassette (paper cassette) capable of storing papers, first and second rollers transporting the papers, a guide plate (regulating portion) provided parallel to the direction for transporting the papers for coming into contact with first side surfaces of the papers and a pressing member (pressing portion) pressing second side surfaces of the papers so that the first side surfaces of the papers come into contact with the guide plate. In this paper feeder according to Japanese Patent No. 2900655, the pressing member is so formed as to press front portions of the second side surfaces of the papers.

The aforementioned Japanese Patent Laying-Open No. 2005-298112 discloses an image generating apparatus comprising a paper feed tray (paper cassette) capable of storing papers, a feed roll (roller) transporting the papers, two guide plates (regulating portions) provided substantially parallel to the direction for transporting the papers for coming into contact with both side surfaces of the papers respectively, a plate spring (pressing portion) provided on the second guide plate to press second side surfaces of the papers for bringing first side surfaces of the papers into contact with the first guide plate and a rack member adjusting the interval between the two guide plates in response to the size of the papers. In this image generating apparatus according to Japanese Patent Laying-Open No. 2005-298112, the second guide plate is so formed as to keep an attitude substantially parallel to the direction for transporting the papers through the rack member provided on a longitudinal end thereof.

The aforementioned Japanese Patent No. 3723664 discloses a paper feeder comprising a receiving plate (paper cassette) capable of receiving recording papers, a paper feed roller transporting the recording papers, two side guides (regulating portions) provided parallel to the direction for transporting the recording papers for coming into contact with both side surfaces of the recording papers respectively and a rack adjusting the interval between the two side guides in response to the size of the recording papers. However, no structure for suppressing an inclination (skew) of the recording papers resulting from the paper feed roller transporting the same is mentioned in relation to this paper feeder according to Japanese Patent No. 3723664.

In the laser beam printer described in the aforementioned Japanese Patent No. 2966243, however, the reference guide provided on the upstream side is so formed as to come into contact with the portions close the ends of the sheet materials on the upstream side, and hence this reference guide is released from the contact with the sheet materials in an early stage after starting the transportation of the sheet materials and consequently the attitudes of the sheet materials are destabilized. In this laser beam printer, therefore, the attitudes of the sheet materials cannot be stabilized when the same are fed, and hence an inclination (skew) of the sheet materials cannot be reliably suppressed.

In the paper feeder described in the aforementioned Japanese Patent No. 2900655, the pressing member presses only the front portions of the second side surfaces of the papers, and hence it is disadvantageously difficult to stabilize the attitudes of the rear portions of the papers. In this paper feeder, therefore, the attitudes of the papers are so destabilized when the papers are transported that an inclination (skew) thereof cannot be reliably suppressed.

In the image generating apparatus described in the aforementioned Japanese Patent Laying-Open No. 2005-298112, the attitude of the second guide plate is kept only by the rack member provided on the longitudinal end thereof, and hence the second guide plate is so unstable in structure that it is difficult to keep the attitude parallel to the direction for transporting the papers. Consequently, it is difficult to stabilize the attitudes of the papers in this image generating apparatus, and the attitudes of the papers are so destabilized that an inclination (skew) thereof cannot be reliably suppressed.

In relation to the paper feeder described in the aforementioned Japanese Patent No. 3723664, no structure for suppressing an inclination (skew) of the recording papers resulting from the paper feed roller transporting the same is mentioned, and hence no countermeasure can conceivably be adopted if the recording papers are inclined (skewed) due to a manufacturing error of the paper feed roller or the like. Therefore, this paper feeder cannot reliably suppress an inclination of the recording papers when the same are transported.

SUMMARY OF THE INVENTION

The present invention has been proposed in order to solve the aforementioned problems, and an object of the present invention is to provide an image generating apparatus capable of reliably suppressing an inclination of papers when feeding the same.

An image generating apparatus according to an aspect of the present invention comprises an apparatus body so formed that a paper cassette storing a paper is mountable thereon and first and second rollers for feeding the paper from the paper cassette to the apparatus body, having rotating axes arranged in a second direction substantially perpendicular to a first direction for feeding the paper. The second roller is arranged closer to the first direction than the first roller and so formed as to have a length exceeding the width of the paper in the second direction, the paper cassette includes a pressing portion employed for pressing a first side surface of the paper rearward with respect to the first direction when the paper cassette stores the paper and so arranged that the distance from the second roller is smaller than the length of the paper in the first direction when the paper cassette is mounted on the apparatus body, and the pressing portion is provided on a first inner side surface of the paper cassette opposite to a direction for inclining the paper with the first roller when the first roller feeds the paper to the apparatus body.

In the image generating apparatus according to the first aspect, as hereinabove described, the paper cassette is so formed as to include the pressing portion employed for pressing the first side surface of the paper rearward with respect to the first direction when the paper cassette stores the paper and provided on the first inner side surface of the paper cassette opposite to the direction for inclining the paper with the first roller when the first roller feeds the paper to the apparatus body, whereby the pressing portion presses the first side surface of the paper opposite to the direction for inclining the same rearward with respect to the paper feed direction when the first roller feeds the paper. Thus, the pressing portion inclines the front side of the paper oppositely to the direction for inclining the paper with the first roller, and feeds the paper to be inclined oppositely to the direction for inclining the same with the first roller. In this image generating apparatus, therefore, the first roller and the pressing portion mutually cancel the inclinations of the paper in the respective directions, whereby the paper can be fed with no inclination. Further, the second roller is arranged closer to the first direction than the first roller and so formed as to have the length exceeding the width of the paper in the second direction so that the second roller transports the paper in contact with the overall cross-directional region thereof in the second direction, whereby the attitude of the paper can be stabilized. In addition, the pressing portion is so arranged that the distance from the second roller is smaller than the length of the paper in the first direction when the paper cassette is mounted on the apparatus body so that the pressing portion presses the first side surface on the rear side of the paper also when the second roller comes into contact with the front side of the paper in the first direction, whereby the attitude of the paper can be reliably stabilized. Therefore, the image generating apparatus according to this aspect can feed the paper with no inclination and reliably stabilize the attitude of the paper, thereby reliably suppressing an inclination of the paper when feeding the same.

In the image generating apparatus according to the aforementioned aspect, the pressing portion is preferably provided on a position where the distance from a rear side surface of the paper cassette provided rearward with respect to the first direction is smaller than half the length of the paper in the first direction. According to this structure, the pressing portion can easily press the first side surface of the paper stored in the paper cassette on the rear side in the first direction.

In the image generating apparatus according to the aforementioned aspect, the paper cassette preferably includes a first regulating portion provided on a second inner side surface of the paper cassette opposite to the first inner side surface of the paper cassette substantially parallelly to the first direction for regulating a second side surface of the paper. According to this structure, the pressing portion so presses the first side surface of the paper that the first regulating portion comes into contact with the second side surface of the paper to regulate movement of the paper in the second direction, whereby the attitude of the paper can be more reliably stabilized.

In this case, the paper cassette preferably further includes a second regulating portion for regulating the first side surface of the paper on the first inner side surface of the paper cassette. According to this structure, the first regulating portion regulates movement of the paper toward the second side surface while the second regulating portion regulates movement of the paper toward the first side surface, whereby the attitude of the paper can be further stabilized.

In the aforementioned structure having the paper cassette including the first regulating portion, the first regulating portion is preferably integrally formed on the first inner side surface of the paper cassette. According to this structure, the first regulating portion may not be separately provided, whereby increase in the number of components can be suppressed.

In the image generating apparatus according to the aforementioned aspect, the pressing portion of the paper cassette is preferably integrally formed on the first inner side surface of the paper cassette, and so urged as to press the first side surface of the paper when the paper cassette is mounted on the apparatus body. According to this structure, the pressing portion may not be separately provided, whereby increase in the number of components can be suppressed. Further, the pressing portion is not urged when the paper cassette is not mounted on the apparatus body, whereby the pressing portion can be inhibited from reduction of the pressing force resulting from change over time.

In this case, the pressing portion of the paper cassette is preferably formed to be deflectable. According to this structure, the pressing portion can easily press the first side surface of the paper when deflected toward the inside of the paper cassette.

In the aforementioned structure having the pressing portion formed to be deflectable, the pressing portion of the paper cassette preferably has a projecting portion protruding toward the inside of the paper cassette on the first inner side surface of the paper cassette, and is preferably so formed as to press the first side surface of the paper with the projecting portion. According to this structure, the pressing portion is so deflected toward the inside of the paper cassette that the projecting portion protruding toward the inside of the paper cassette easily comes into contact with the first side surface of the paper, whereby the pressing portion can more easily press the first side surface of the paper with the projecting portion.

In the aforementioned structure having the pressing portion integrally formed on the first inner side surface of the paper cassette, the paper cassette preferably further includes a lid portion having a contact portion coming into contact with the pressing portion for urging the pressing portion to press the first side surface of the paper, and the contact portion preferably so comes into contact with the pressing portion as to urge the pressing portion to press the first side surface of the paper when the paper cassette is mounted on the apparatus body. According to this structure, the pressing portion, reliably urged by the contact portion of the lid portion coming into contact with the same, can easily press the paper.

In this case, the contact portion is preferably integrally provided on the lid portion. According to this structure, the contact portion may not be provided separately from the lid portion, whereby increase in the number of components can be suppressed.

In the aforementioned structure having the paper cassette including the lid portion, the lid portion is preferably so slid in the first direction that the contact portion comes into contact with the pressing portion when the paper cassette is mounted on the apparatus body. According to this structure, the contact portion can be easily brought into contact with the pressing portion by sliding the lid portion, whereby the pressing portion can more easily press the first side surface of the paper.

In this case, the pressing portion preferably has a protrusive section protruding outward from the paper cassette on the rear surface of the first inner side surface of the paper cassette, and the contact portion of the lid portion preferably so comes into contact with the protrusive section that the pressing portion is deflectable toward the inside of the paper cassette. According to this structure, the protrusive section protruding outward from the paper cassette so comes into contact with the contact portion that the pressing portion is easily deflected toward the inside of the paper cassette, whereby the pressing portion can more easily press the first side surface of the paper.

In the aforementioned structure including the pressing portion having the protrusive section, a part of the contact portion coming into contact with the protrusive section is preferably rounded. According to this structure, the lid portion can be smoothly slid in the first direction while bringing the contact portion into contact with the protrusive section.

In the image generating apparatus according to the aforementioned aspect, the center of the first roller in the second direction is preferably arranged on a position separated by a prescribed distance from the center of the paper cassette in the second direction toward the direction for inclining the paper with the first roller when the paper cassette is mounted on the apparatus body. According to this structure, the first roller feeds the paper to incline the same toward the direction where the first roller is arranged, whereby the inclination of the paper by the first roller can be easily canceled by working the pressing force of the pressing portion on the paper in the direction for canceling the inclination of the paper.

The image generating apparatus according to the aforementioned aspect preferably further comprises a third roller on a position opposed to the second roller, and the second roller is preferably so formed as to feed the paper to the apparatus body while holding the paper between the second roller and the third roller. According to this structure, the paper can be transported in the state held between the second and third rollers, whereby the attitude of the paper can be more stabilized.

The image generating apparatus according to the aforementioned aspect preferably further comprises a paper separating member separating a plurality of papers stored in the paper cassette one by one from each other. According to this structure, the papers can be fed one by one to the apparatus body also when the paper cassette stores a plurality of papers.

The image generating apparatus according to the aforementioned aspect preferably further comprises a push-up lever for pushing up the paper for bringing the paper stored in the paper cassette into contact with the first roller. According to this structure, the paper is so reliably brought into contact with the first roller that the first roller can reliably feed the paper to the apparatus body.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of a sublimatic printer 100 according to the embodiment of the present invention is described with reference to FIGS. 1 to 14. According to this embodiment, the present invention is applied to the sublimatic printer 100 employed as an exemplary image generating apparatus.

Figure 1:
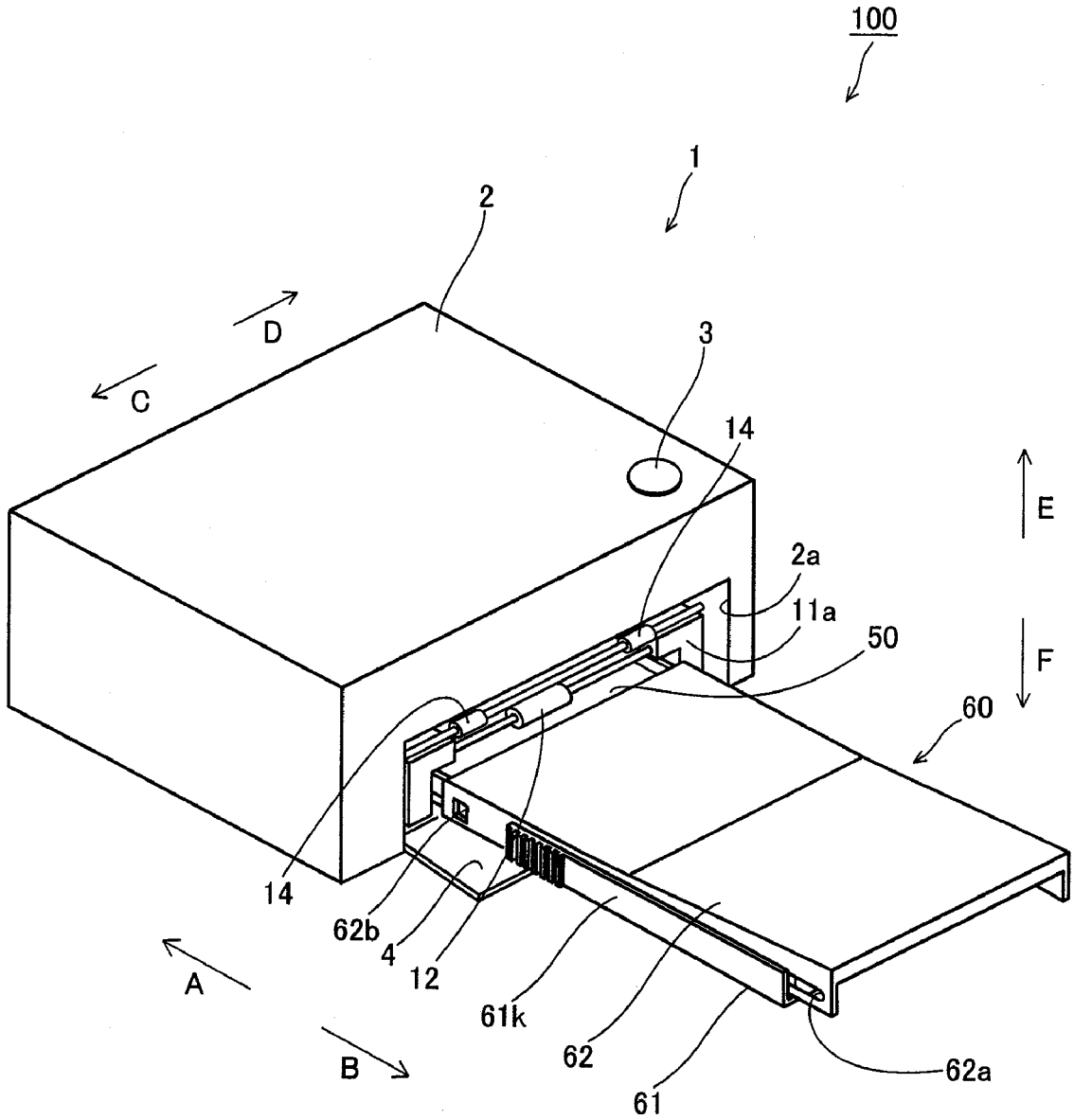
FIG. 1 is a perspective view showing the overall structure of a sublimatic printer according to an embodiment of the present invention.
Figure 2:
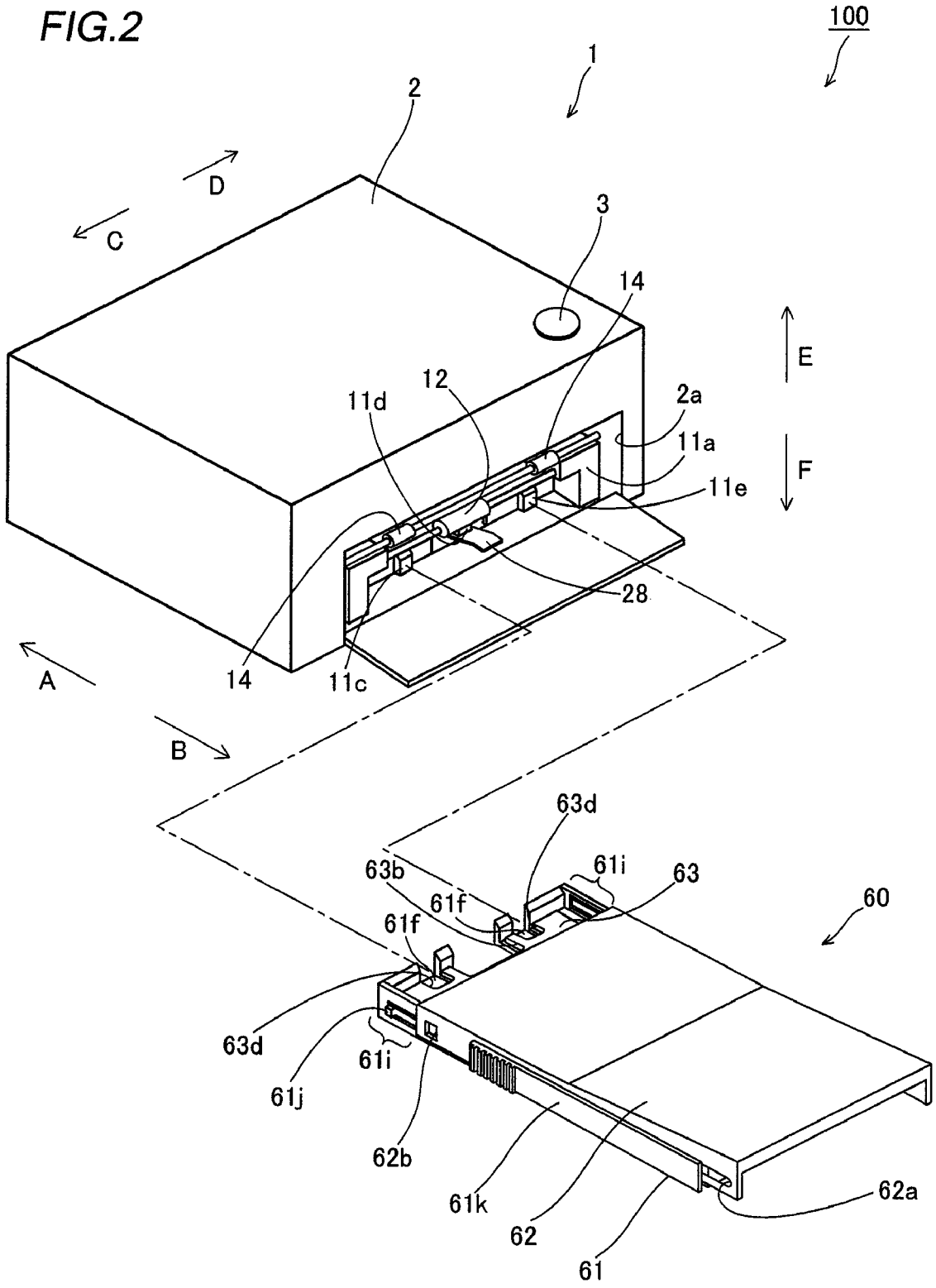
FIG. 2 is a perspective view showing a state where a paper cassette is detached from a printer body of the sublimatic printer according to the embodiment shown in FIG. 1.
Figure 3:
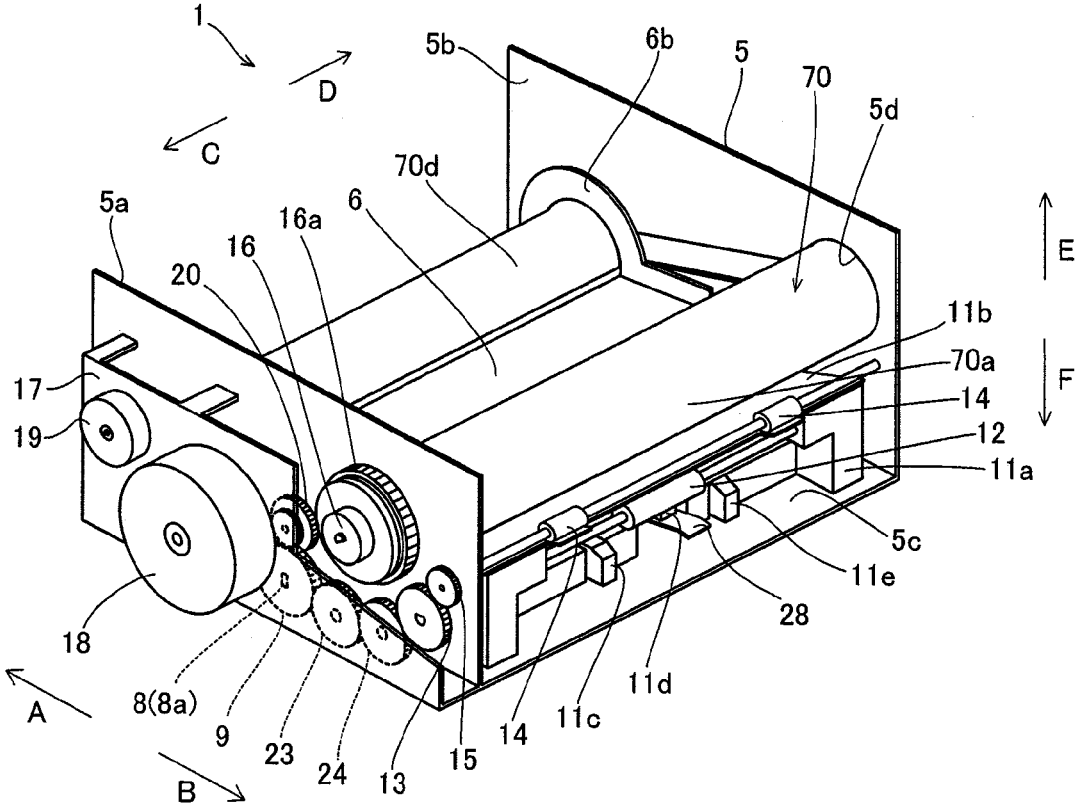
FIG. 3 is a perspective view showing the inner part of a housing of the sublimatic printer according to the embodiment shown in FIG. 1.

As shown in FIGS. 1 and 2, the sublimatic printer 100 according to the embodiment of the present invention comprises a printer body 1 mountable with a paper cassette 60 storing papers 50 (see FIG. 1), a housing 2 storing a printing function, a power supply button 3 arranged on the upper surface of the housing 2 and a lid 4 mounted on the front surface (side surface along arrow B) of the housing 2 to be capable of blocking up an opening 2*a* so provided as to receive the paper cassette 60. As shown in FIG. 3, the sublimatic printer 100 further comprises a chassis 5 of metal, a print head 6 for printing, a platen roller 7 (see FIG. 6) opposed to the print head 6, a feed roller 8 (see FIG. 6) of metal, a feed roller gear 9, a press roller 10 (see FIG. 6) of metal coming into contact with the feed roller 8 with prescribed pressing force, a lower paper guide 11*a* of resin, an upper paper guide 11*b* of resin, a paper feed roller 12 of rubber, a paper feed roller gear 13, a paper discharge roller 14 of rubber and a paper discharge roller gear 15 in the housing 2. The feed roller 8 is an example of the "second roller" in the present invention, and the paper feed roller 12 is an example of the "first roller" in the present invention. The sublimatic printer 100 further comprises an ink sheet take-up reel 16, a motor bracket 17 of sheet metal, a stepping motor 18 for transporting the papers 50 (see FIG. 1), another stepping motor 19 serving as a driving source for rotating the print head 6, a swingable swing gear 20 and a plurality of intermediate gears 21 to 24 (see FIG. 4). An ink sheet cartridge 70 storing an ink sheet 71 (see FIG. 6) capable of printing 20 papers 50 is detachably mounted on the sublimatic printer 100 according to this embodiment.

As shown in FIG. 3, the chassis 5 of metal has a first side surface 5*a*, a second side surface 5*b* and a bottom surface 5*c* coupling the first and second side surfaces 5*a* and 5*b* with each other. The aforementioned motor bracket 17 of sheet metal is mounted on the first side surface 5*a* of the chassis 5. The second side surface 5*b* of the chassis 5 is provided with a receiving hole 5*d* for receiving the ink sheet cartridge 70.

Figure 5:
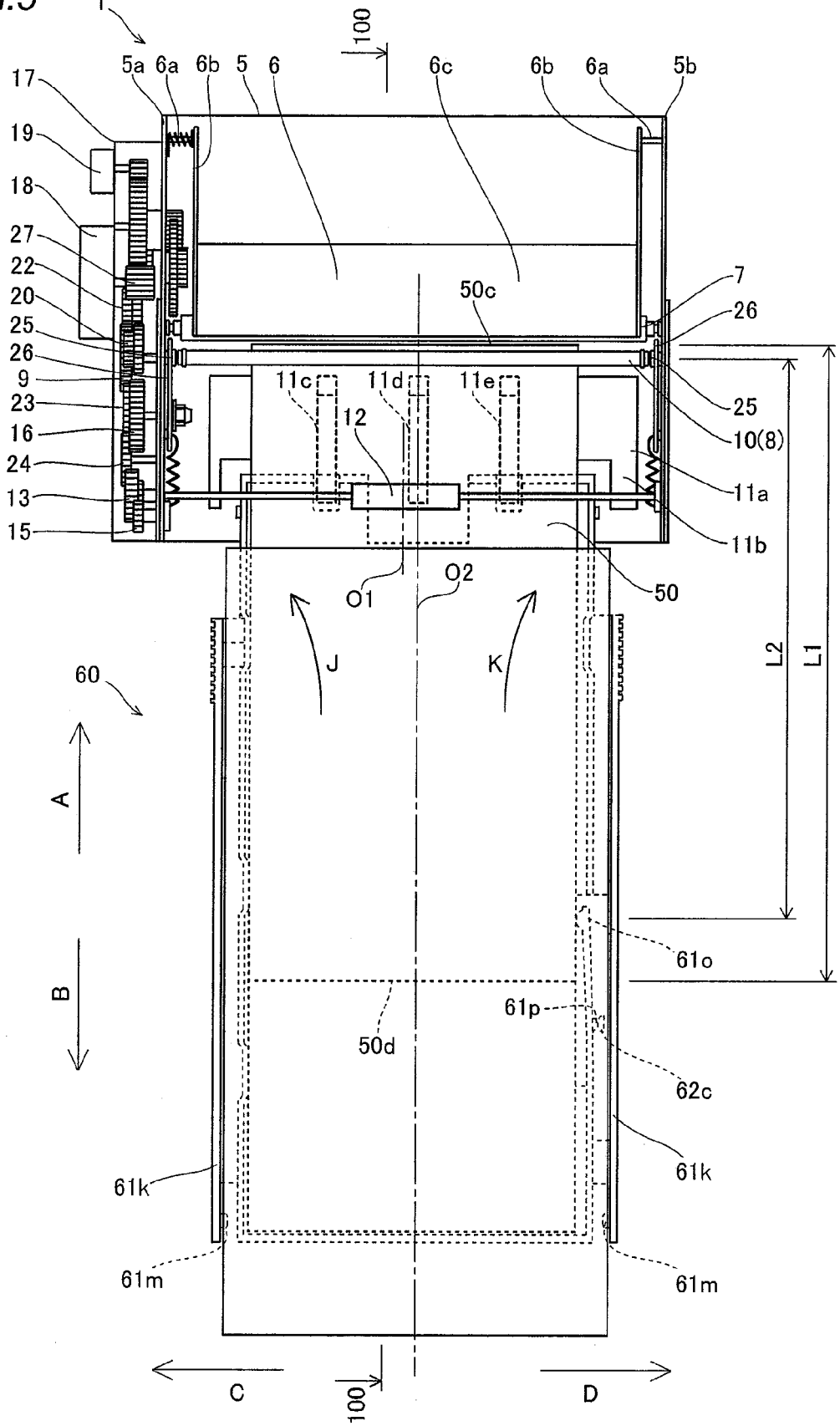
FIG. 5 is a plan view showing the overall structure of the sublimatic printer according to the embodiment shown in FIG. 1.
Figure 6:
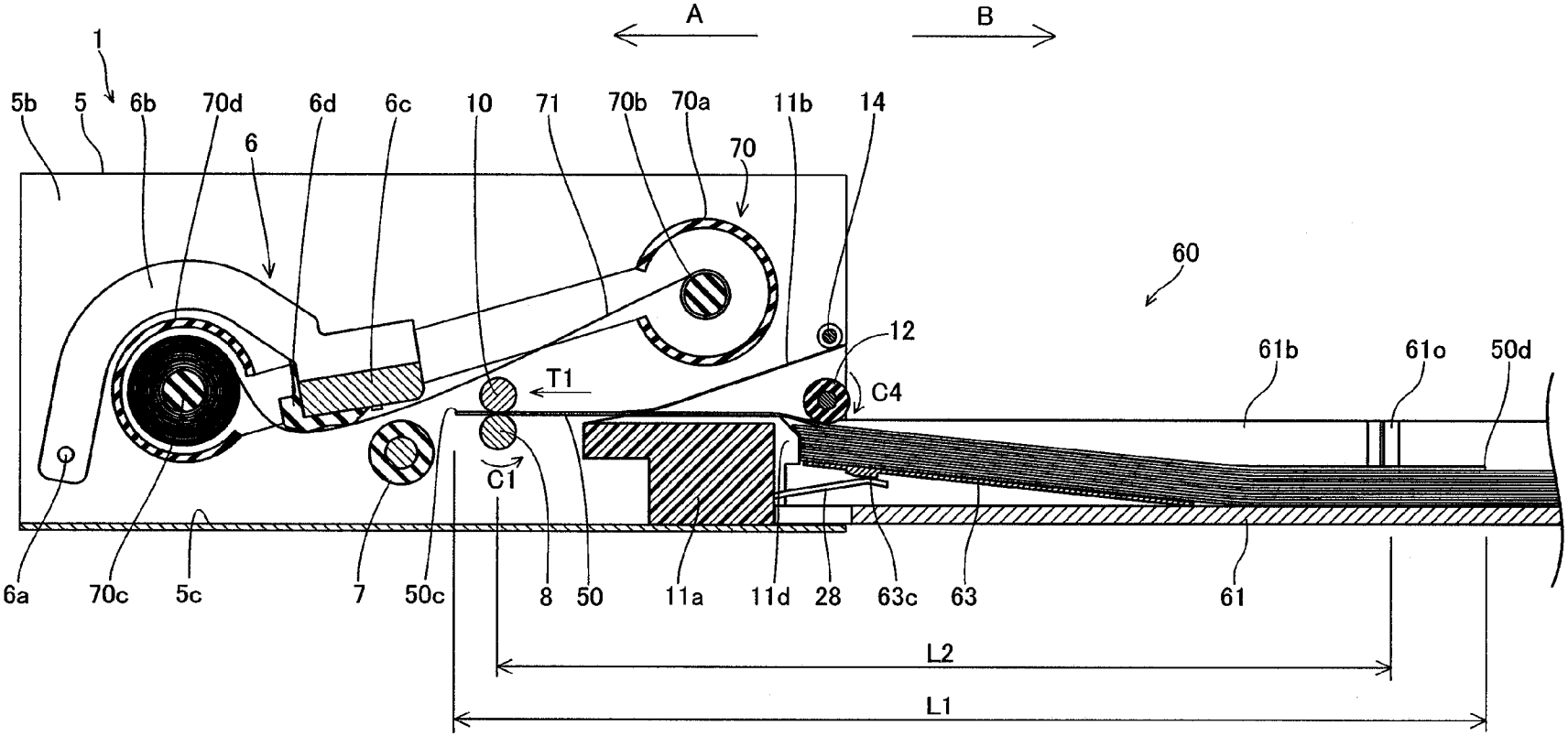
FIG. 6 is a sectional view for illustrating the internal structure of the sublimatic printer according to the embodiment shown in FIG. 1.

The print head 6 is constituted of a pair of support shafts 6*a*, a pair of arm portions 6*b*, a head portion 6*c* and a paper feed guide member 6*d* (see FIG. 6) of resin mounted from under the lower surface of the head portion 6*c*, as shown in FIGS. 5 and 6. This print head 6 is mounted inside the first and second side surfaces 5*a* and 5*b* of the chassis 5 to be rotatable about the support shafts 6*a*, as shown in FIG. 5.

The platen roller 7 (see FIG. 6) is rotatably arranged inside the first and second side surfaces 5*a* and 5*b* of the chassis 5.

Figure 4:
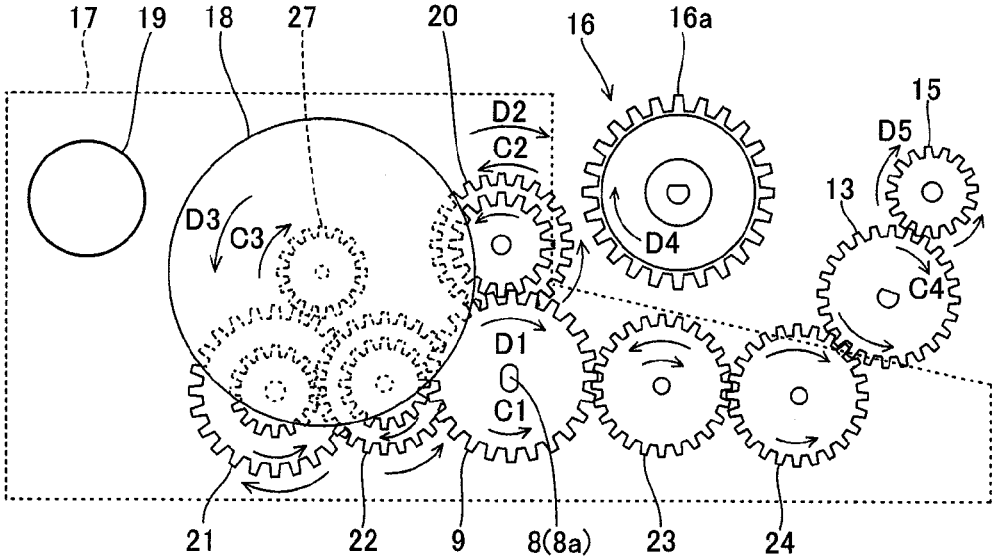
FIG. 4 is a side elevational view showing the arrangement of stepping motors and gears in the sublimatic printer according to the embodiment shown in FIG. 1.

According to this embodiment, the feed roller 8 has a feed roller gear insert portion 8*a* inserted into the feed roller gear 9, as shown in FIGS. 3 and 4. The feed roller 8 is rotatably supported by a feed roller bearing (not shown) mounted on the chassis 5, and has a rotating axis arranged in a direction (along arrows C and D) perpendicular to the direction for feeding the papers 50. Further, the feed roller 8 is arranged closer to the paper feed direction (along arrow A) for the papers 50 than the paper feed roller 12 and has a length exceeding the width of the papers 50 in the direction (along arrows C and D) perpendicular to the paper feed direction, as shown in FIG. 5. Thus, the feed roller 8 transports the papers 50 in contact with the overall cross-directional regions of the papers 50, thereby stabilizing the attitudes of the papers 50.

Both ends of the press roller 10 are rotatably supported by a pair of press roller bearings 25 of resin, as shown in FIG. 5. The press roller bearings 25 are mounted on bearing support plates 26 of metal. The bearing support plates 26 are arranged inside the first and second side surfaces 5*a* and 5*b* of the chassis 5 to press the press roller 10 against the feed roller 8 (see FIG. 6) with urging force of springs (not shown).

Figure 7:
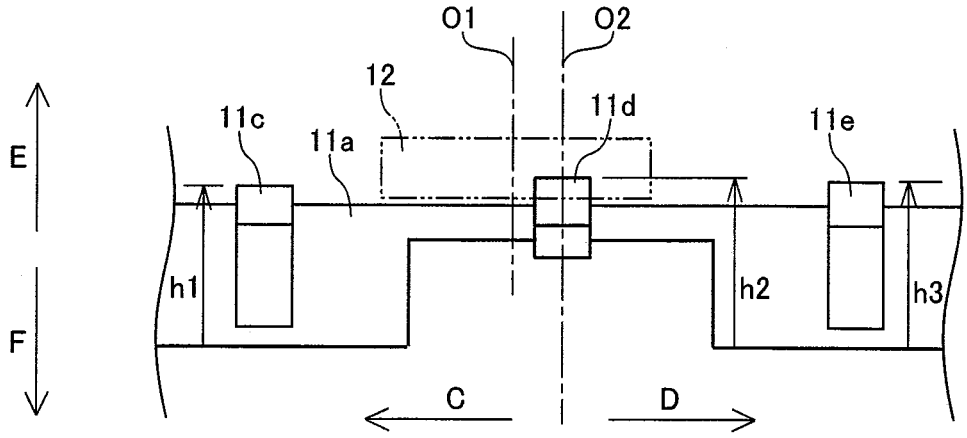
FIG. 7 illustrates paper separating members in the sublimatic printer according to the embodiment shown in FIG. 1.

The lower paper guide 11*a* is set in the vicinity of the feed roller 8 and the press roller 10, as shown in FIG. 6. The upper paper guide 11*b* is mounted on the upper portion of the lower paper guide 11*a*. This upper paper guide 11*b* has a function of guiding the papers 50 to a paper feed path toward a printing portion (position where the head portion 6*c* of the print head 6 and the platen roller 7 are opposed to each other) through the lower surface in paper discharge and to guide the papers 50 to a paper discharge path through the upper surface. As shown in FIGS. 3, 5 and 7, the lower paper guide 11*a* is integrally provided with paper separating members 11*c*, 11*d* and 11*e* successively along arrow C, in order to separate the papers 50 fed to the printer body 1 one by one from each other. The paper separating members 11*c*, 11*d* and 11*e* are so formed that the central paper separating member 11*d* has the largest height h2, the paper separating member 11*e* provided along arrow D has the intermediate height h3 and the paper separating member 11*c* provided along arrow C has the smallest height h1. Thus, the paper separating members 11*c*, 11*d* and 11*e* having the heights h1, h2 and h3 different from each other as described above can reliably separate the papers 50 stored in the paper cassette 60 in an overlapping manner one by one from each other, to be fed to the printer body 1.

According to this embodiment, the paper feed roller 12 is rotated by the stepping motor 18 serving as the driving source for feeding the papers 50 (see FIG. 6) from the paper cassette 60 (see FIG. 1) mounted on the printer body 1 into the printer body 1, as shown in FIG. 3. As shown in FIG. 5, the rotating axis of the paper feed roller 12 is arranged in the direction (along arrows C and D) perpendicular to the direction (along arrow A) for feeding the papers 50 while the center O1 thereof in the direction perpendicular to the direction for feeding the papers 50 is arranged on a position separated from the center O2 of the paper cassette 60 mounted on the printer body 1 by a prescribed distance along arrow C. Thus, the paper feed roller 12 can feed the papers 50 to be inclined toward the direction (along arrow J in FIG. 5) of the arrangement of the paper feed roller 12.

The paper discharge roller 14 is rotated by the stepping motor 18 serving as the driving source, for discharging the papers 50 printed in the printer body 1 from the printer body 1.

The ink sheet take-up reel 16 (see FIG. 3) is so formed as to take up the ink sheet 71 by engaging with a take-up bobbin 70*b* rotatably arranged in a take-up portion 70*a* of the ink sheet cartridge 70, as shown in FIG. 6. A gear portion 16*a* of the ink sheet take-up reel 16 is arranged to be engageable with the swing gear 20 upon swinging thereof, as shown in FIG. 4.

A motor gear 27 is mounted on a shaft portion of the stepping motor 18 mounted on the motor bracket 17, as shown in FIG. 5. The stepping motor 18 functions as the driving source for driving the gear portion 16*a* of the ink sheet take-up reel 16, the paper feed roller gear 13, the paper discharge roller gear 15 and the feed roller gear 9. The stepping motor 19 functions as the driving source for a pressing member (not shown) pressing the upper surface of the print head 6 for pressing the print head 6 (see FIG. 6) against the platen roller 7 (see FIG. 6).

The sublimatic printer 100 further comprises a push-up lever 28 pushing up a paper push-up member 63 of the paper cassette 60 described later, as shown in FIGS. 2 and 3.

Figure 8:
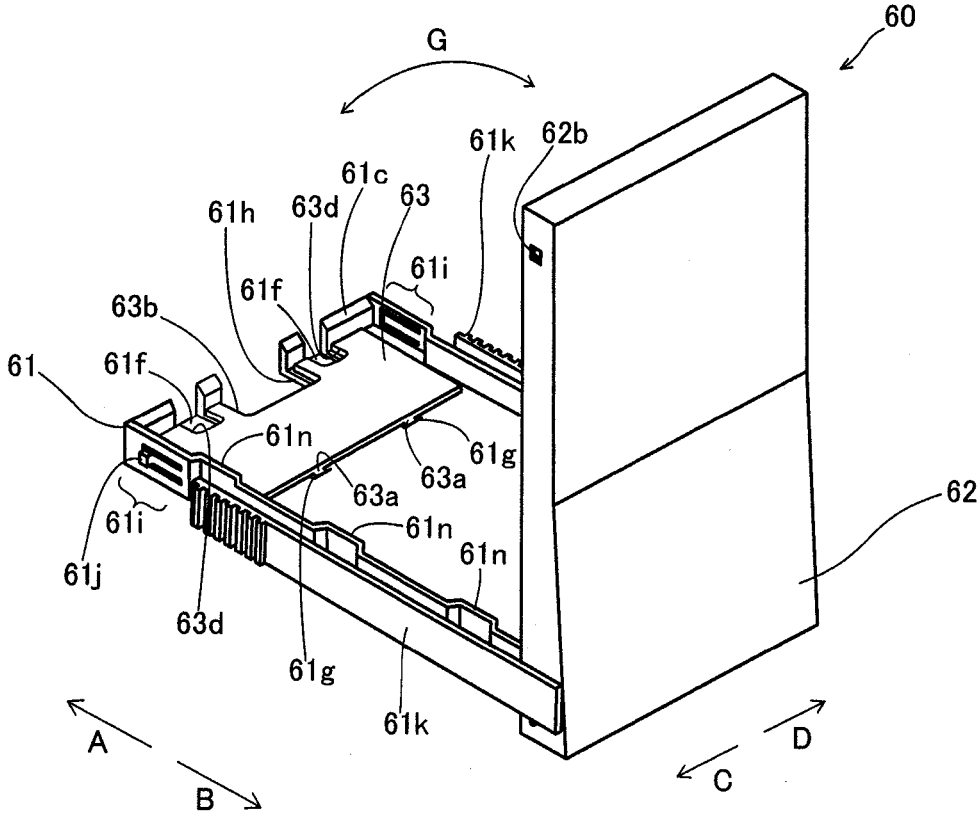
FIGS. 8 and 9 are perspective views showing the structure of the paper cassette in the sublimatic printer according to the embodiment shown in FIG. 1.
Figure 9:
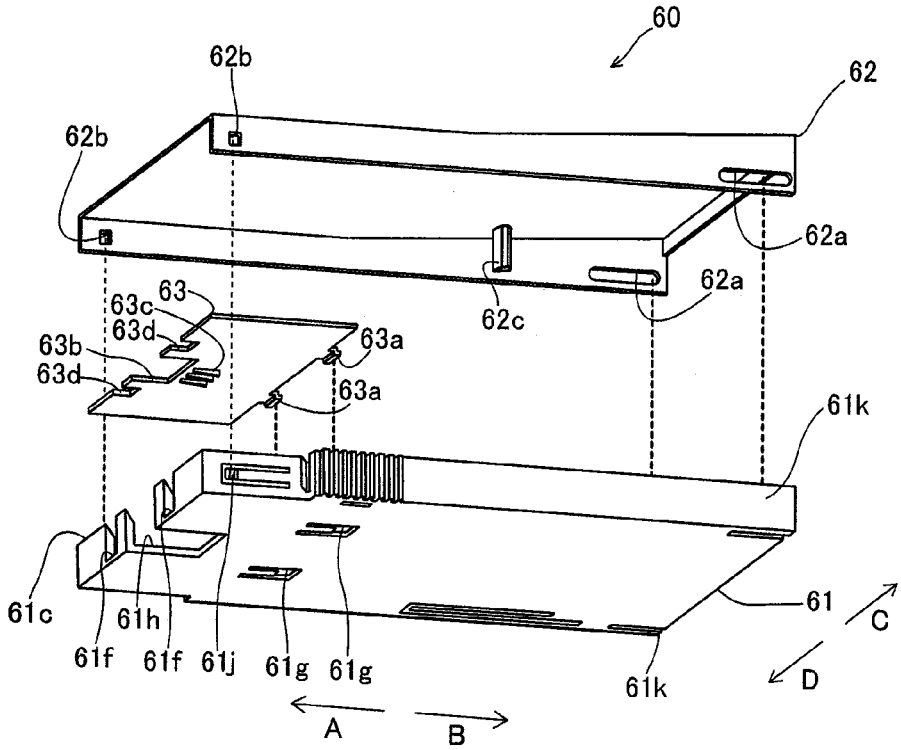
Figure 10:
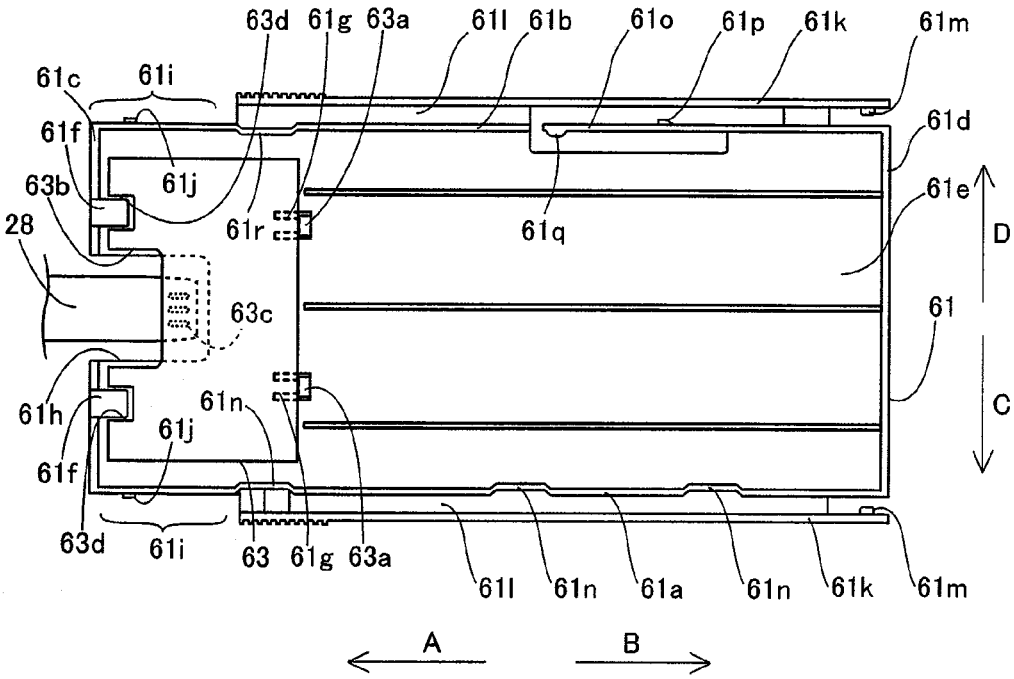
FIGS. 10 to 13 are plan views showing the structure of the paper cassette in the sublimatic printer according to the embodiment shown in FIG. 1.

As shown in FIGS. 8 to 10, the paper cassette 60 is constituted of a paper storage member 61, an openable/closable lid member 62 and the paper push-up member 63. The lid member 62 is an example of the "lid portion" in the present invention. The paper push-up member 63 is pushed up by the push-up lever 28, thereby bringing the papers 50 into contact with the paper feed roller 12 of the printer body 1.

The paper storage member 61 is provided for storing the papers 50 (see FIG. 6) fed to the printer body 1, and constituted of a bottom surface and side surfaces 61*a*, 61*b*, 61*c* and 61*d* extending perpendicularly to the bottom surface along arrows C, D, A and B respectively. The side surface 61*a* is an example of the "second inner side surface" in the present invention, and the side surface 61*b* is an example of the "first inner side surface" in the present invention. The side surface 61*d* is an example of the "rear side surface" in the present invention. As shown in FIG. 10, the bottom surface of the paper storage member 61 is constituted of a paper receiving portion 61*e* receiving the papers 50 (see FIG. 6), two recess portions 61*f* fitted with the paper separating members 11*c* and 11*e* (see FIG. 7) respectively when the paper storage member 61 is mounted on the printer body 1, a mounting hole 61*g* engaging with an engaging portion 63*a* of the paper push-up member 63 described later and a notch 61*h*. The notch 61*h* is so provided as to prevent the aforementioned push-up lever 28 (see FIG. 3) of the printer body 1 from coming into contact with the bottom surface of the paper storage member 61. In other words, the push-up lever 28 of the printer body 1 is located under the notch 61*h* and so formed as to push up the paper push-up member 63 through the notch 61*h*, as shown in FIG. 10.

Printer insert portions 61*i* inserted into the opening 2*a* (see FIG. 1) of the housing 2 are provided on an end of the paper storage member 61 along arrow A. The side surfaces 61*a* and 61*b* corresponding to the printer insert portions 61*i* are provided with outwardly protruding engaging sections 61*j* respectively. The engaging sections 61*j* engage with engaging portions (not shown) provided on the printer body 1 while the recess portions 61*f* provided on the bottom surface engage with the paper separating members 11*c* and 11*e* (see FIG. 7) of the printer body 1, so that the paper cassette 60 is mounted on the opening 2*a*.

As shown in FIGS. 8 to 10, mounting portions 61*k* for the lid member 62 are provided on the outer sides of the side surfaces 61*a* and 61*b* of the paper storage member 61 respectively. The mounting portions 61*k* for the lid member 62 are opposed to the outer surfaces of the side surfaces 61*a* and 61*b* at prescribed intervals from the side surfaces 61*a* and 61*b* respectively. The mounting portions 61*k* for the lid member 62 are coupled to the paper storage member 61 through coupling portions 611. First ends (along arrow A) of the outer side surfaces of the two mounting portions 61*k* are so corrugated that the user can grasp and slide the same. Shaft portions 61*m* engaging with slots 62*a* of the lid member 62 described later are provided on second ends (along arrow B) of the inner side surfaces of the two mounting portions 61*k*.

Figure 11:
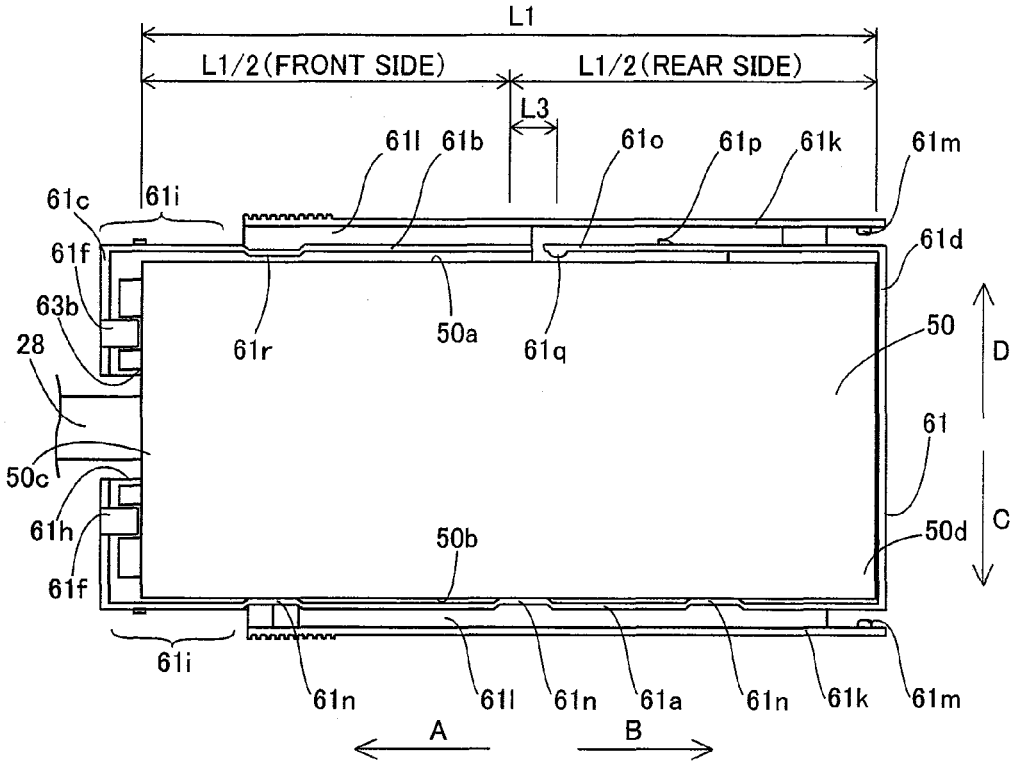
Figure 12:
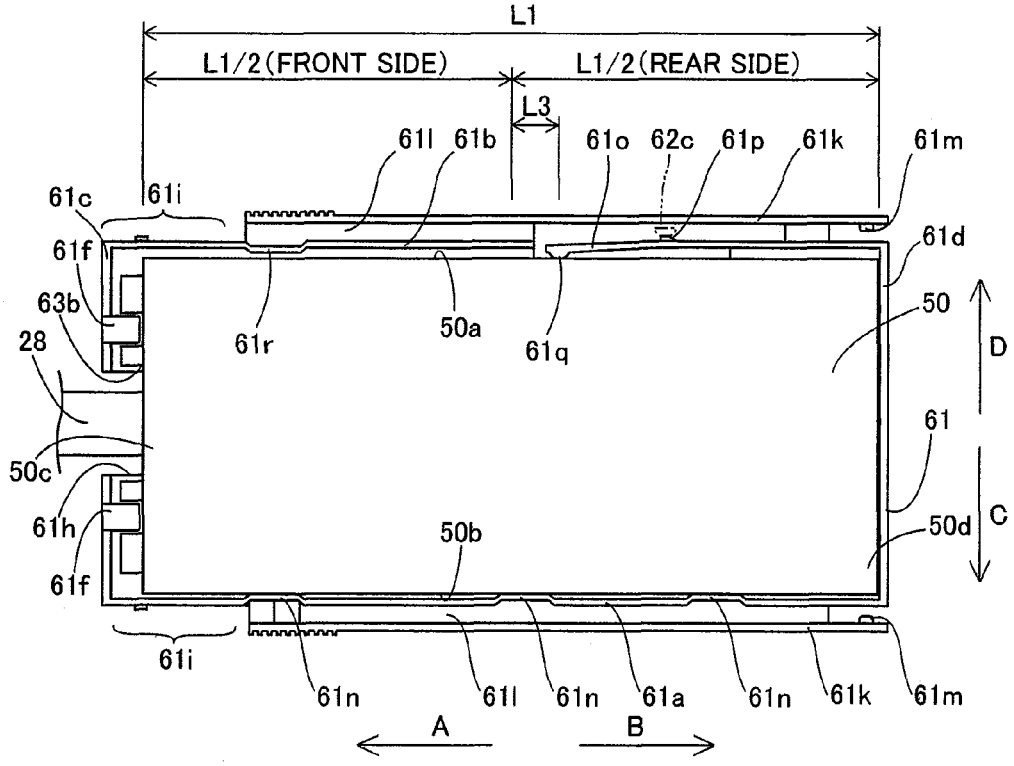

According to this embodiment, a regulating portion 61*n* provided parallel to the direction (along arrow A) for feeding the papers 50 for regulating second side surfaces 50*b* of the papers 50 is integrally formed on the side surface 61*a* of the paper storage member 61, as shown in FIGS. 11 and 12. Another regulating portion 61*r* for regulating first side surfaces 50*a* of the papers 50 is integrally formed on the side surface 61*b* opposed to the side surface 61*a* and opposite to the direction (along arrow J in FIG. 5) for inclining the papers 50 fed to the printer body 1 with the paper feed roller 12. The regulating portion 61*n* is an example of the "second regulating portion" in the present invention, and the regulating portion 61*r* is an example of the "first regulating portion" in the present invention. A paper pressing portion 61*o* is integrally provided on the side surface 61*b*, to be deflectable (along arrow C) toward the inside of the paper storage member 61. A protrusive section 61*p* is integrally provided on the side of the paper pressing portion 61*o* opposed to the mounting portions 61*k*. A projecting portion 61*q* is formed on an end of the paper pressing portion 61*o* along arrow A, to protrude (along arrow C) toward the inside of the paper storage member 61. The paper pressing portion 61*o* is an example of the "pressing portion" in the present invention.

As shown in FIG. 12, the protrusive section 61*p* is pressed by a boss portion 62*c* of the lid member 62 described later, so that the paper pressing portion 61*o* is deflected toward the inside of the paper storage portion 61. Thus, the projecting portion 61*q* presses the first side surfaces 50*a* of the papers 50, whereby the second side surfaces 50*b* of the papers 50 opposite to the first side surfaces 50*a* are so brought into contact with the regulating portion 61*n* that movement of the papers 50 along arrows C and D is regulated. As shown in FIGS. 11 and 12, the projecting portion 61*q* of the paper pressing portion 61*o* is so arranged as to press regions of the first side surfaces 50*a* closer to rear sides 50*d* by a prescribed distance L3 than the centers of the papers 50 having the length L1 in the paper feed direction (along arrow A) when the papers 50 are stored in the paper storage member 61. More specifically, the projecting portion 61*q* is arranged on a position where the distance from the side surface 61*d* of the paper storage member 61 along arrow B is smaller than half the length L1 of the papers 50 in the paper feed direction (along arrow A). Thus, the rear sides 50*d* of the papers 50 in the paper feed direction (along arrow A) are pressed along arrow C when the papers 50 are fed to the printer body 1, whereby front sides 50*c* of the papers 50 are inclined along arrow D and the papers 50 are consequently fed to be inclined along arrow K, as shown in FIG. 5. Further, the projecting portion 61*q* of the paper pressing portion 61*o* is so arranged that the distance L2 from the feed roller 8 is smaller than the length L1 of the papers 50 in the paper feed direction (along arrow A) when the paper cassette 60 is mounted on the printer body 1, as shown in FIGS. 5 and 6. Thus, the projecting portion 61*q* of the paper pressing portion 61*o* can press the regions of the first side surfaces 50*a* closer to the rear sides 50*d* also when the front sides 50*c* of the papers 50 reach the feed roller 8.

Figure 13:
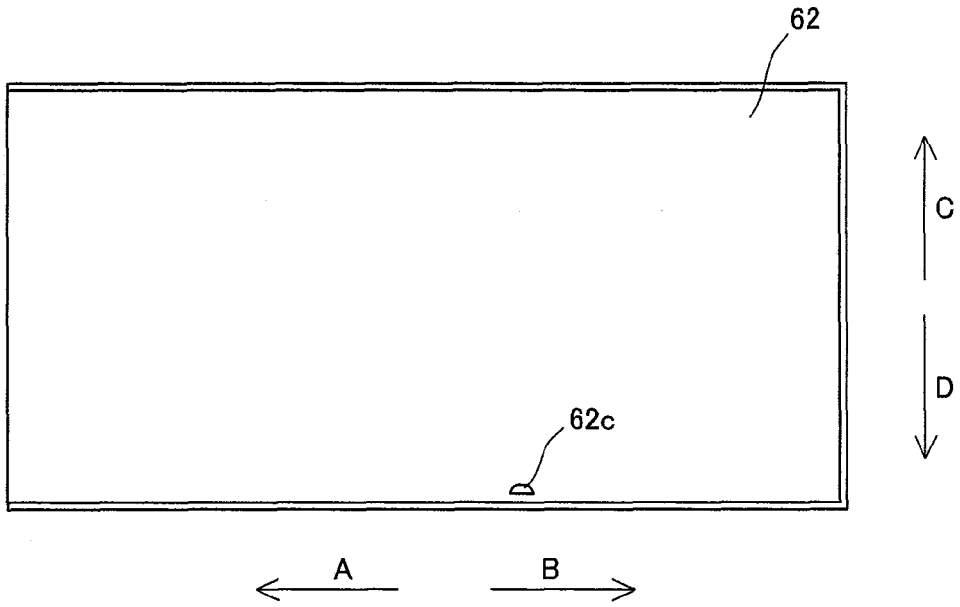

As shown in FIGS. 8 and 9, the lid member 62 is so provided as to prevent the paper storage member 61 from invasion of dust or the like thereby preventing the papers 50 from contamination. This lid member 62 has side surfaces perpendicular to the bottom surface of the paper storage member 61 respectively along arrows C and D. The slots 62*a* engaging with the aforementioned shaft portions 61*m* of the paper storage member 61 are provided on first ends of the side surfaces of the lid member 62 respectively. Holes 62*b* are provided on second ends of the side surfaces of the lid member 62 for engaging with the engaging sections 61*j* of the paper storage member 61 respectively when the paper cassette 60 is closed. When the paper cassette 60 is mounted on the printer body 1, the lid member 62 covers the paper storage member 61 so that the slots 62*a* engaging with the shaft portions 61*m* are arranged on endmost positions along arrow B, as shown in FIG. 5. In this arrangement, the boss portion 62*c* for pressing the protrusive section 61*p* of the paper pressing portion 61*o* is integrally formed on the lid member 62, as shown in FIGS. 9, 12 and 13. A region of the boss portion 62*c* coming into contact with the protrusive section 61*p* is rounded. Thus, the boss portion 62*c* can be smoothly slid in contact with the protrusive section 61*p*. The boss portion 62*c* is an example of the "contact portion" in the present invention. The slots 62*a* of the lid member 62 and the shaft portions 61*m* (see FIG. 10) of the paper storage member 61 engaging with each other are slidable along arrows A and B, and openable/closable along arrow G, as shown in FIG. 8. The boss portion 62*c* so comes into contact with the protrusive section 61*p* as to press the same only when the paper cassette 60 is mounted on the printer body 1, as shown in FIGS. 5 and 12. In other words, the boss portion 62*c* comes into contact with the protrusive section 61*p* only when the paper cassette 60 is mounted on the printer body 1, so that the projecting portion 61*q* of the paper pressing portion 61*o* presses the first side surfaces 50*a* of the papers 50. The boss portion 62*c* and the protrusive section 61*p* are so formed as to smoothly come into contact with each other when the lid member 62 is slid along arrows A and B respectively.

Figure 14:
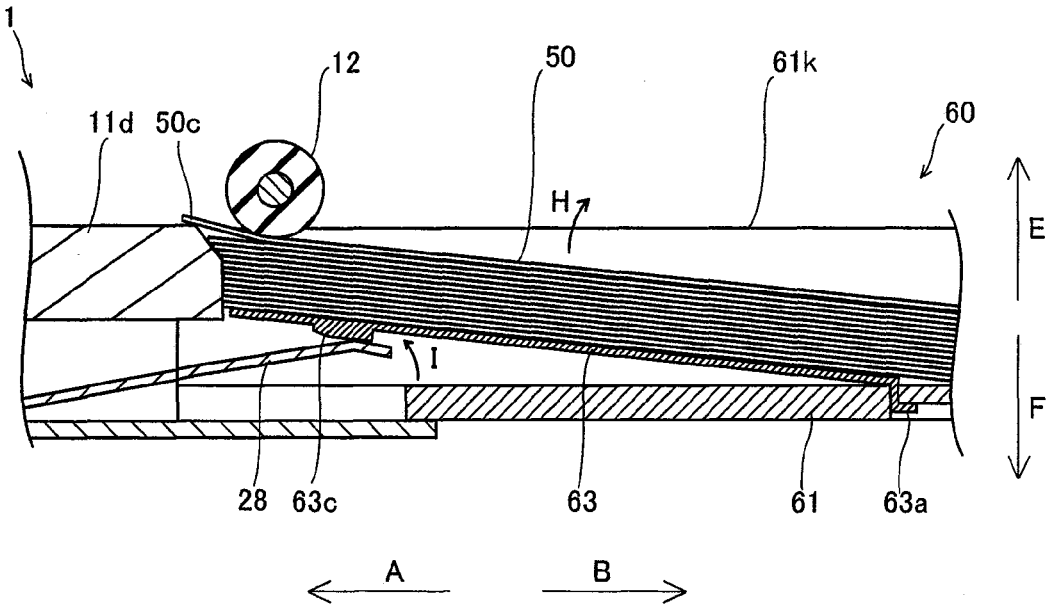
FIG. 14 is a sectional view of a portion around a paper feed roller in the sublimatic printer according to the embodiment shown in FIG. 1.

As shown in FIGS. 8 to 10, the paper push-up member 63 is integrally provided with engaging portions 63*a* rotatably engaging with mounting holes 61*g* of the paper storage member 61 respectively. The paper push-up member 63 is further provided with a notched relief portion 63*b* for preventing the paper push-up member 63 and the paper feed roller 12 from coming into contact with each other when the paper push-up member 63 rotates in a paper push-up direction (along arrow H in FIG. 14) about the engaging portion 63*a*. The paper push-up member 63 is further integrally provided with protrusions 63*c* for further pushing up the papers 50 on a surface opposed to the paper receiving portion 61*e* of the paper storage member 61, as shown in FIGS. 9, 10 and 14. The protrusions 63*c* are provided on a position coming into contact with the push-up lever 28 of the printer body 1, as shown in FIGS. 10 and 14. Further, the paper push-up member 63 is provided with notches 63*d* corresponding to the recess portions 61*f* of the paper storage member 61, for preventing the paper separating members 11*c* and 11*e* (see FIG. 7) of the printer body 1 and the paper push-up member 63 from coming into contact with each other when the paper cassette 60 is mounted on the printer body 1, as shown in FIGS. 8 to 10.

The ink cartridge 70 is provided with a supply portion 70*d* having a supply bobbin 70*c* wound with the ink sheet 71 rotatably arranged therein, as shown in FIG. 6. The ink sheet 71 is formed by successively linking three color ink sheets, i.e., a Y (yellow) printing sheet, an M (magenta) printing sheet and a C (cyan) printing sheet and a transparent OP (overcoat) sheet for protecting printed surfaces of the papers 50. Printing sheet identification portions (not shown) recognized by an ink sheet search sensor (not shown) in print starting are provided between the color printing sheets and the portion connecting the C (cyan) printing sheet and the OP (overcoat) sheet with each other respectively.

An operation of the sublimatic printer 100 according to the embodiment of the present invention for feeding the papers 50 to the printer body 1 is now described with reference to FIGS. 5, 12 and 14.

First, the lid member 62 of the paper cassette 60 is so slid (see FIG. 5) that the projecting portion 61*q* of the paper pressing portion 61*o* presses the first side surfaces 50*a* of the papers 50 stored in the paper storage member 61 along arrow C and the second side surfaces 50*b* of the papers 50 come into contact with the regulating portion 61*n*, which in turn regulates movement of the papers 50 along arrows C and D, as shown in FIG. 12. At this time, regions (printer insert portions 61*i*) corresponding to the opening 2*a* of the housing 2 are exposed, and the engaging sections 61*j* of the paper storage member 61 are disengaged from the holes 62*b* of the lid member 62. When the paper cassette 60 is mounted on the printer body 1, the engaging sections 61*j* of the paper storage member 61 engage with the engaging portions (not shown) provided on the printer body 1 while the paper separating members 11*c* and 11*e* of the printer body 1 and the two recess portions 61*f* of the paper storage member 61 engage with each other respectively, whereby the paper cassette 60 is mounted on the opening 2*a* provided on the housing 2.

When a printing operation is started, the push-up lever 28 is rotated along arrow I in association with a gear (not shown) provided in the printer body 1, as shown in FIG. 14. A first end of the push-up lever 28 pushes up the protrusions 63*c* of the paper push-up member 63, thereby rotating the paper push-up member 63 pushed up by the push-up lever 28 along arrow H about the engaging portion 63*a*. The papers 50 placed on the paper push-up member 63 come into contact with the paper feed roller 12, thereby stopping the rotation of the push-up lever 28 and the paper push-up member 63. The paper feed roller 12 in contact with the papers 50 is so rotated that the papers 50 are separated one by one from each other by the paper separating members 11*c*, 11*d* and 11*e* and thereafter fed to the printer body 1.

According to this embodiment, the papers 50 are inclined along arrow J by the paper feed roller 12, and simultaneously inclined along arrow K by the projecting portion 61*q* of the paper pressing portion 61*o*. The inclinations along arrows J and K cancel with each other, whereby the papers 50 are consequently fed along arrow A with no inclination. Also when the front sides 50*c* of the papers 50 reach the feed roller 8, the regions of the first side surfaces 50*a* of the papers 50 closer to the rear sides 50*d* are pressed by the projecting portion 61*q* of the paper pressing portion 61*o* so that the attitudes thereof are stabilized. Thereafter the papers 50 are transported while the overall cross-directional regions thereof in the direction (along arrows C and D) perpendicular to the paper feed direction (along arrow A) are held between and pressed by the feed roller 8 and the press roller 10. Thus, the papers 50 are thereafter fed with no inclination in the transport direction (along arrow A) also after the regions of the first side surfaces 50*a* closer to the rear sides 50*d* are released from the projecting portion 61*q*, to be subjected to printing.

According to this embodiment, as hereinabove described, the paper cassette 60 is so formed as to include the paper pressing portion 61*o* pressing the regions of the first side surfaces 50*a* of the papers 50 closer to the rear sides 50*d* with respect to the paper feed direction (along arrow A) when the paper cassette 60 stores the papers 50 while the paper pressing portion 61*o* is provided on the side surface 61*b* of the paper cassette 60 opposite (along arrow D) to the direction (along arrow J in FIG. 5) for inclining the papers 50 when the papers 50 are fed to the printer body 1 by the paper feed roller 12, whereby the paper pressing portion 61*o* presses the regions of the first side surfaces 50*a* of the papers 50 closer to the rear sides 50*d* with respect to the paper feed direction opposite to the direction for inclining the papers 50 fed to the printer body 1. Thus, the paper pressing portion 61*o* presses the front sides 50*c* of the papers 50 to be inclined oppositely (along arrow K in FIG. 5) to the direction for inclining the papers 50 with the paper feed roller 12. In this sublimatic printer 100, therefore, the inclinations through the paper feed roller 12 and the paper pressing portion 61*o* along arrows J and K cancel with each other, whereby the papers 50 can be fed with no inclination. The feed roller 8 is arranged closer to the paper feed direction than the paper feed roller 12 and so formed as to have the length exceeding the width of the papers 50 along arrows C and D for transporting the papers 50 in contact with the overall cross-directional regions of the papers 50 along arrows C and D, whereby the attitudes of the papers 50 can be stabilized. The projecting portion 61*q* of the paper pressing portion 61*o* is so arranged that the distance L2 from the feed roller 8 is smaller than the length L1 of the papers 50 in the paper feed direction when the paper cassette 60 is mounted on the printer body 1 for pressing the regions of the first side surfaces 50*a* of the papers 50 closer to the rear sides 50*d* also when the front sides 50*a* of the papers 50 in the paper feed direction come into contact with the feed roller 8, whereby the attitudes of the papers 50 can be reliably stabilized. Thus, the sublimatic printer 100 can feed the papers 50 with no inclination and reliably stabilize the attitudes of the papers 50, thereby reliably suppressing an inclination of the papers 50 fed to the printer body 1.

According to this embodiment, the paper pressing portion 61*o* of the paper cassette 60 is provided with the projecting portion 61*q* protruding toward the inside of the paper cassette 60 so that the projecting portion 61*q* easily comes into contact with the first side surfaces 50*a* of the papers 50 when the paper pressing portion 61*o* is deflected toward the inside of the paper cassette 60, thereby easily pressing the first side surfaces 50*a* of the papers 50.

According to this embodiment, the projecting portion 61*q* of the paper pressing portion 61*c* is arranged on the position where the distance from the side surface 61*d* of the paper storage member 61 along arrow B is smaller than half the length L1 of the papers 50, thereby easily pressing the regions of the first side surfaces 50*a* of the papers 50 stored in the paper cassette 60 closer to the rear sides 50*d*.

According to this embodiment, the paper cassette 60 is so formed as to include the regulating portion 61*n* provided on the side surface 61*a* thereof opposed to the side surfaces 61*b* substantially parallelly to the paper feed direction (along arrow A) for regulating the second side surfaces 50*b* of the papers 50 so that the projecting portion 61*q* of the paper pressing portion 61*o* presses the first side surfaces 50*a* of the papers 50 while the second side surfaces 50*b* of the papers 50 come into contact with the regulating portion 61*n* which in turn regulates movement of the papers 50 along arrows C and D, whereby the attitudes of the papers 50 can be more reliably stabilized.

According to this embodiment, the paper pressing portion 61*o* is integrally formed on the side surface 61*b* of the paper cassette 60 and so urged as to press the first side surfaces 50*a* of the papers 50 only when the paper cassette 60 is mounted on the printer body 1 so that the paper pressing portion 61*o* may not be separately provided, whereby increase in the number of components can be suppressed. Further, the paper pressing portion 61*o* is not urged when the paper cassette 60 is not mounted on the printer body 1, whereby the paper pressing portion 61*o* can be inhibited from reduction of the pressing force resulting from change over time.

According to this embodiment, the boss portion 62*c* of the lid member 62 is so formed as to come into contact with the protrusive section 61*p* for urging the paper pressing portion 61*o* to press the first side surfaces 50*a* of the papers 50 only when the paper cassette 60 is mounted on the paper body 60 for reliably coming into contact with the protrusive section 61*p* for urging the paper pressing portion 61*o*, whereby the paper pressing portion 61*o* can easily press the papers 50.

According to this embodiment, the protrusive section 61*p* is provided on the side of the paper pressing portion 61*o* opposed to the mounting portions 61*k* and the paper pressing portion 61*o* is deflected toward the inside of the paper storage portion 61 when the boss portion 62*c* of the lid member 62 presses the protrusive section 61*p* so that the paper pressing portion 61*o* is easily deflected toward the inside of the paper storage portion 61 when the boss portion 62*c* comes into contact with the protrusive section 61*p* outwardly protruding from the paper storage portion 61, whereby the paper pressing portion 61*o* can easily press the first side surfaces 50*a* of the papers 50.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the sublimatic printer employed as an exemplary image generating apparatus, the present invention is not restricted to this but is also applicable to another image generating apparatus other than the sublimatic printer so far as the same comprises an apparatus body mountable with a paper cassette and a roller feeding papers.

While the paper pressing portion is integrally provided on the paper cassette as an exemplary pressing portion in the aforementioned embodiment, the present invention is not restricted to this but the pressing portion may alternatively be provided independently of the paper cassette.

While the paper pressing portion is urged to press the papers only when the paper cassette is mounted on the printer body in the aforementioned embodiment, the present invention is not restricted to this but the paper pressing portion may alternatively be regularly urged to press the papers.

While the center of the paper feed roller is arranged closer the direction for inclining the papers with the paper feed roller than the center of the paper cassette for inclining the papers in a prescribed direction in the aforementioned embodiment, the present invention is not restricted to this but the papers may alternatively be inclined in the prescribed direction by adjusting the heights of the plurality of paper separating members, for example.

What is claimed is:

1. An image generating apparatus comprising:

an apparatus body so formed that a paper cassette storing a paper is mountable thereon; and first and second rollers for feeding said paper from said paper cassette to said apparatus body, having rotating axes arranged in a second direction substantially perpendicular to a first direction for feeding said paper, wherein said second roller is arranged at a position further in said first direction than a position at which said first roller is arranged and so formed as to have a length exceeding the width of said paper in said second direction, said paper cassette includes a pressing portion employed for pressing a first side surface of said paper rearward with respect to said first direction when said paper cassette stores said paper and the pressing portion arranged so that the distance from said second roller to the pressing portion is smaller than the length of said paper in said first direction when said paper cassette is mounted on said apparatus body, and said pressing portion is provided on a first inner side surface of said paper cassette opposite to a direction for inclining said paper with said first roller when said first roller feeds said paper to said apparatus body, and wherein said paper cassette further includes a first regulating portion for regulating said first side surface of said paper on said first inner side surface of said paper cassette, said first regulating portion being arranged at a position further in said first direction than a position at which said pressing portion is arranged, wherein the first regulating portion is operatively configured to regulate the first side surface of the paper at a fixed regulating position; and wherein the pressing portion is operatively configured to press the first side surface of the paper rearward with respect to the first direction at an inner position of the paper cassette in the second direction further in than the fixed regulation position at which the first regulating portion regulates the first side surface of the paper.

2. The image generating apparatus according to claim 1, wherein said pressing portion is provided at a position where the distance from a rear side surface of said paper cassette provided rearward with respect to said first direction is smaller than half the length of said paper cassette in said first direction.

3. The image generating apparatus according to claim 1, wherein said paper cassette includes a second regulating portion provided on a second inner side surface of said paper cassette opposite to said first inner side surface of said paper cassette substantially parallel to said first direction for regulating a second side surface of said paper.

4. The image generating apparatus according to claim 3, wherein said second regulating portion is integrally formed on said second inner side surface of said paper cassette.

5. The image generating apparatus according to claim 1, further comprising a push-up lever for pushing up said paper for bringing said paper stored in said paper cassette into contact with said first roller.

6. The image generating apparatus according to claim 1, wherein said pressing portion of said paper cassette is integrally formed on said first inner side surface of said paper cassette, and so urged as to press said first side surface of said paper when said paper cassette is mounted on said apparatus body.

7. The image generating apparatus according to claim 6, wherein said pressing portion of said paper cassette is deflectable.

8. The image generating apparatus according to claim 6, wherein said pressing portion of said paper cassette has a projecting portion protruding toward the inside of said paper cassette on said first inner side surface of said paper cassette, and presses said first side surface of said paper with said projecting portion.

9. The image generating apparatus according to claim 6, wherein said paper cassette further includes a lid portion having a contact portion coming into contact with said pressing portion for urging said pressing portion to press said first side surface of said paper, and said contact portion so comes into contact with said pressing portion as to urge said pressing portion to press said first side surface of said paper when said paper cassette is mounted on said apparatus body.

10. The image generating apparatus according to claim 9, wherein said contact portion is integrally provided on said lid portion.

11. The image generating apparatus according to claim 9, wherein said lid portion is so slid in said first direction that said contact portion comes into contact with said pressing portion when said paper cassette is mounted on said apparatus body.

12. The image generating apparatus according to claim 11, wherein said pressing portion has a protrusive section protruding outward from said paper cassette on the rear surface of said first inner side surface of said paper cassette, and said contact portion of said lid portion so comes into contact with said protrusive section that said pressing portion is deflectable toward the inside of said paper cassette.

13. The image generating apparatus according to claim 12, wherein a part of said contact portion coming into contact with said protrusive section is rounded.

14. The image generating apparatus according to claim 1, wherein the center of said first roller in said second direction is arranged on a position separated by a prescribed distance from the center of said paper cassette in said second direction toward said direction for inclining said paper with said first roller when said paper cassette is mounted on said apparatus body.

15. The image generating apparatus according to claim 1, further comprising a third roller on a position opposed to said second roller, wherein said second roller is so formed as to feed said paper to said apparatus body while holding said paper between said second roller and said third roller.

16. The image generating apparatus according to claim 1, further comprising a paper separating member separating a plurality of said papers stored in said paper cassette one by one from each other.

* * * * *